United States Patent [19]

Miskolczi, Jr.

[11] Patent Number: 4,584,812

[45] Date of Patent: Apr. 29, 1986

[54] REFRACTORY BRICK RING TIGHTENING DEVICE

[76] Inventor: John Miskolczi, Jr., 10631 Sagevale, Houston, Tex. 77089

[21] Appl. No.: 554,538

[22] Filed: Nov. 23, 1983

[51] Int. Cl.[4] ..... E04B 1/32

[52] U.S. Cl. ..... 52/749; 264/32; 405/135; 405/151; 52/245

[58] Field of Search ..... 52/749, 750, 245, 224; 110/331, 334; 432/3, 162; 33/180 R, 174 E, 465, 475; 405/151, 135; 264/31, 32

[56] References Cited

U.S. PATENT DOCUMENTS

| | | | |
|---|---|---|---|
| 369,168 | 8/1887 | Deering | 52/227 |
| 777,606 | 12/1904 | Creamer et al. | 33/174 E |
| 807,935 | 12/1905 | Jackson | 249/209 |
| 2,328,768 | 9/1943 | Arndt | 33/174 E |
| 2,610,470 | 9/1952 | White | 254/100 |
| 2,612,675 | 10/1952 | Wread | 249/11 |
| 2,829,877 | 4/1958 | Davis, Jr. | 52/245 |
| 3,246,442 | 4/1966 | Sauer | 52/747 |
| 3,458,641 | 7/1969 | Perucchetti . | |
| 3,488,965 | 1/1970 | Chesnov | 405/151 |
| 4,088,719 | 5/1978 | Heath | 264/30 |

FOREIGN PATENT DOCUMENTS

| | | | |
|---|---|---|---|
| 1208569 | 12/1959 | France | 405/151 |

*Primary Examiner*—James L. Ridgill, Jr.

*Attorney, Agent, or Firm*—Arnold, White & Durkee

[57] ABSTRACT

An apparatus for tightening a ring of refractory brick in order to accommodate the installation of the key brick into a key brick space of such a refractory brick ring to tightly close and complete the ring is provided. The apparatus includes an expansion frame including a first end and a second end. The first end is selectively attachable to a first brick on one side of the key brick space at a point on the first brick remote to the key brick space. The second end is selectively attachable to a second brick on the opposing side of the key brick space at a point on the second brick remote to the key brick space. A power device is associated with the expansion frame for providing outwardly opposing force on the first and second ends such that circumferential compressive force is exerted on the refractory brick ring remotely from the key brick space to tighten the ring. A method of tightening the ring of refractory brick in order to accommodate the installation of a key brick into a key brick space of such a refractory brick ring is also disclosed.

6 Claims, 6 Drawing Figures

Fig. 1
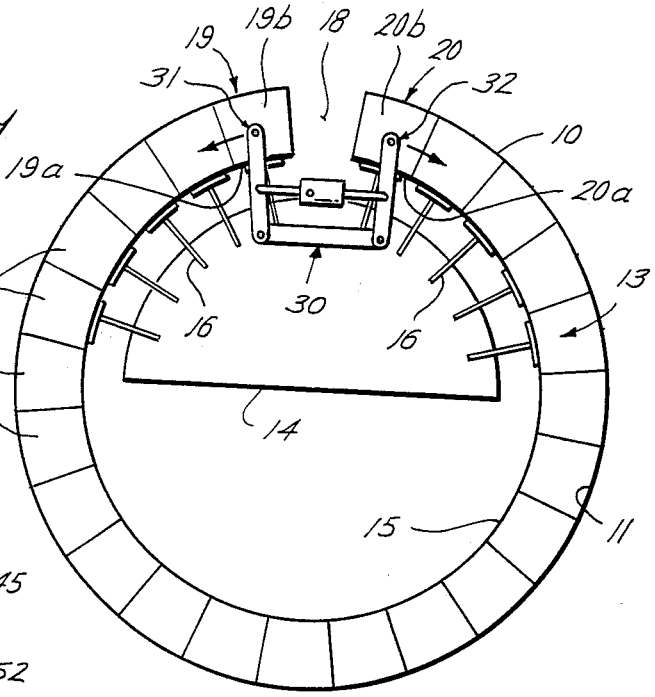
Fig. 2
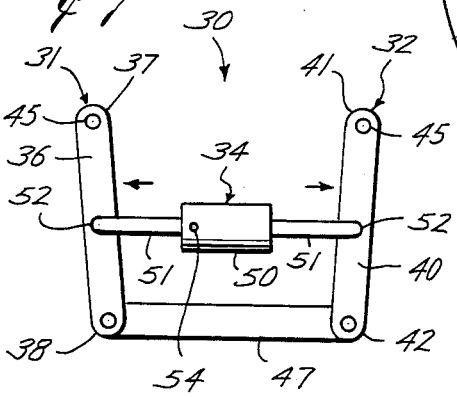
Fig. 3
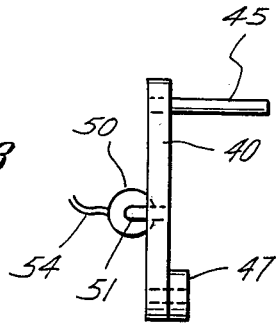
Fig. 4
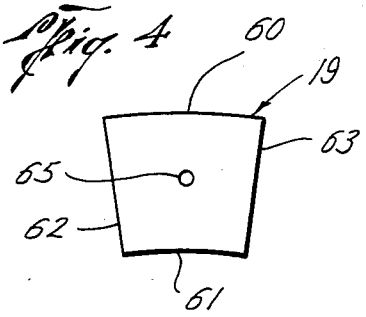
Fig. 5
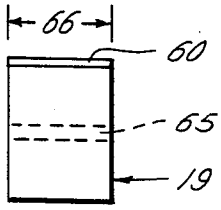
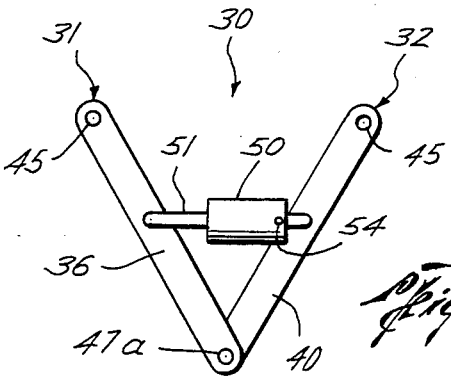
Fig. 6

REFRACTORY BRICK RING TIGHTENING DEVICE

BACKGROUND OF THE INVENTION

The invention relates generally to an apparatus for tightening a ring of refractory brick; more particularly it relates to an apparatus for tightening a ring of refractory brick without occupying the key brick space of such a ring.

Rings of refractory brick are often used as lining for abrasion and heat resistance within a cylindrical shell. The life of the refractory lining depends, in part, upon the tightness with which it is constructed. In particular, the tighter the construction of the ring of brick the longer the life of the lining. It is therefore desirable to have a device which accommodates maximum tightening of the ring.

Many attempts have been made to provide a means to sufficiently tighten a ring of refractory brick. The general concept behind some of the presently-employed methods is to place an expandable device between the last two bricks in the ring, in what is referred to as the key brick space, to compress and tighten the ring. Typically, however, the device must be withdrawn before the final, or key, brick can be inserted to complete the ring. Such a method is, therefore, disadvantageous for some applications because it allows some loosening of the ring prior to its completion.

Alternatively, the device has been left in the structure and embedded in lining material such as is shown in U.S. Pat. No. 4,088,719 to Heath. This method, however, is believed to be more costly because of the inclusion of the compression device in the refractory ring. Also, it is believed that repair of the ring would be impeded because of the permanence of the installation of the compression device.

Hence, to provide an improved means of tightening a ring of refractory brick, it would be advantageous to provide a means for tightening the ring which maintains compression on the ring while leaving the key brick space open for the insertion or removal of the key brick.

SUMMARY OF THE INVENTION

The present invention overcomes the prior disadvantages through an apparatus for tightening a ring of refractory brick which is securable to the ring remotely to the key brick space such that compression upon a ring can be maintained during the installation of the key brick.

More specifically, an apparatus is provided for tightening a ring of refractory brick in order to accommodate the installation of a key brick into a key brick space, wherein the key brick space is defined on either side by first and second opposing bricks. The apparatus includes an expansion frame including a first end and a second end. The first end is selectively attachable to the first brick at a point on the first brick remote to the key brick space. The second end is selectively attachable to the second brick at a point on the second brick remote from the key brick space. A power means is associated with said expansion frame for providing outwardly opposing force on the first and second ends such that circumferential compressive force is exerted on the refractory brick ring remotely from the key brick space to tighten the ring and accommodate the insertion of the key brick.

In a preferred embodiment of the present invention, the apparatus includes a first extension bar having a working end and a connecting end in which the first end of the expansion frame is secured to the working end of the first extension bar. The apparatus also includes a second extension bar having a working end and a connecting end in which the second end of the expansion frame is secured to the working end of the second extension member. A finite-length connecting member is pivotally secured to the connecting ends of the first extension member and the second extension member.

In a more preferred embodiment of the present invention, the power means comprises a power cylinder including an extendable piston. The cylinder and piston are connected to the first extension member and the second extension members such that the extension of the piston levers the working ends of the first and second extension members to provide the outwardly opposing force on the first and second ends of the expansion frame.

In a still more preferred embodiment of the present invention, the apparatus includes the first and second bricks wherein the bricks are specially formed to be detachably secured to the first and second ends in use.

In a preferred aspect of this embodiment of the present invention, each brick has a bore positioned therein extending into the respective brick from a point remote to the key brick space in use. The first and second ends of the expansion frames then comprise extended members having a configuration complementary to the respective brick bore such that the respective extended member fits into the respective brick bore to detachably secure the expansion frame to the bricks.

The present invention also includes a method of tightening a ring of refractory brick in order to accommodate the installation of a key brick into a key brick space of such a refractory brick ring. In the method of the present invention, wherein the key brick space is defined as being bordered on either side by first and second bricks, the method includes the steps of detachably securing a first end of an expansion frame to the first brick at point on the first brick remote to the key brick space and detachably securing a second end of the expansion frame to the second brick at a point on the second brick remote to the key brick space. The expansion frame is configured to be offset from the key brick space when the first and second ends are attached to the first and second bricks. The distance between the first and second ends is then expanded to exert outwardly opposing force on the first and second bricks in order to exert circumferential compressive force on the ring to tighten the ring. A key brick of width substantially equal to the key brick space is then installed into the key brick space while substantially maintaining the outwardly opposing force on the first and second bricks. Hence, the method of the present invention accommodates the installation of a key brick specially measured to fit snuggly within the key brick space when the refractory brick ring is under compression, thereby insuring the tight completion of the ring.

BRIEF DESCRIPTION OF THE DRAWINGS

These and other advantages of the present invention will be further illustrated by reference to the appended drawings which illustrate particular embodiments of an apparatus constructed in accordance with the present invention.

FIG. 1 is a horizontal plan view of a ring of refractory brick within a cylindrical shell illustrating a positioning of the apparatus of the present invention in use.

FIG. 2 is a plan view of the preferred embodiment of an expansion frame constructed in accordance with the present invention.

FIG. 3 is a side view of the expansion frame shown in FIG. 2.

FIG. 4 is a plan view of a brick adapted for use with the apparatus shown in FIG. 2.

FIG. 5 is a side view of the brick shown in FIG. 4.

FIG. 6 is a plan view of an alternative embodiment of the expansion frame of the present invention.

DETAILED DESCRIPTION OF THE PREFERRED EMBODIMENTS

The present invention is utilized in the construction of a ring of refractory bricks within a cylindrical shell. As shown in FIG. 1, the environment in which the apparatus of the present invention is utilized generally includes a cylindrical shell 10 which forms the outer surface of the vessel to be lined. In lining the interior wall 11 of the cylindrical shell 10, a set of refractory bricks 12 are disposed side by side, or end to end to form a circumferential ring 13 around the shell interior 11, the refractory bricks 12 of the circumferential ring 13 thereby forming an interior refractory surface 15. An installation form 14 having a plurality of radial supports 16 may be utilized during construction of the ring 13 to assist in holding the bricks in place until the final brick can be inserted.

Referring still to FIG. 1, there is illustrated a ring 13 of refractory bricks 12 having a space 18 for insertion of a final brick to complete the ring 13. The space 18, called the key brick space, is bordered on either side by a first refractory brick 19 and a second refractory brick 20. The refractory bricks 19 and 20 are generally comprised of the same refractory material and have a similar overall configuration to a refractory brick 12 such that uniformity of the refractory material is provided around the ring.

The present invention involves a means for installing a key brick of similar refractory material into the key brick space 18 to tightly complete the refractory brick ring 13. As discussed in the Summary Of The Invention, the present invention more specifically provides a means for exerting force outwardly from the key brick space 18 on the first brick 19 and second brick 20 such that circumferential compressive force is exerted on the ring 13 to tighten the ring 13 wherein the means for exerting such force is secured to the bricks 19 and 20 externally from the key brick space 18.

Referring now to FIGS. 1 and 2, the ring tightening device of the present invention includes an expansion frame 30 having a first end 31 and a second end 32. The first end 31 is securable to the first brick 19 at a point on the first brick 19 remote from the key brick space 18 as shown in FIG. 1. The second end 32 is similarly securable to the second brick 20 at a point on the second brick 20 remote from the key brick space 18. The expansion frame 30 is further offset from the key brick space 18 when attached to the first and second bricks 19, 20 in use.

The expansion frame 30 includes a power means 34 mounted to the expansion frame 30 for spreading the first end 31 and second end 32 in order to exert outwardly opposing force from the key brick space 18 onto the first and second ends 31, 32 to provide circumferential compressive force onto the ring 13.

In the preferred embodiment illustrated in FIGS. 1–3, the expansion frame 30 includes a first extension bar 36 and a second extension bar 40. The first extension bar 36 has a working end 37 and a connecting end 38. Similarly, the second extension bar 40 has a working end 41 and a connecting end 42. An extended member 45 comprising an elongated cylindrical rod is secured transversely to the first extension bar 36 in a bore extending therethrough at a point proximate the working end 37 whereby the extended member 45 essentially comprises or functions as the first end 31 of the expansion frame 30. Similarly, an extended member 45 comprising an elongated cylindrical rod is secured to the working end 41 of the second extension bar 40 transversely to the second extension bar 40 to comprise or function as the second end 32.

The first extension bar 36 is interconnected with the second extension bar 40 by means of a fixed length linkage member 47. In the preferred embodiment, the fixed length linkage member 47 is comprised of an elongated flat bar pivotally secured at one end to the connecting end 38 of the first extension bar 36 and at the other end to the connecting end 42 of the second extension bar 40 such that the first extension bar 36, the linkage bar 47, and the second extension bar 40 have a U-shaped configuration of finite base and expandable width between the sides of the U.

Referring now to FIGS. 2 and 3, the power means may comprise any suitable means for exerting an outward force tending to spread and separate the first end 31 and the second end 32. In the preferred embodiment, the power means 34 comprises a power cylinder 50 having opposing extendable pistons 51 extending from each end. The extended pistons 51 are pivotally connected to the first extension bar 36 and second extension bar 40 by pin joints 52 or other suitable means. The cylinder 50 communicates with a power fluid source (not shown) by means of a communicating line 54 as shown in FIG. 2.

In the preferred embodiment, the power cylinder 50 is a hydraulic cylinder having opposing extendable pistons. It will be appreciated by those of skill in the art, however, that a cylinder having a single extendable piston may be utilized as shown in FIG. 6 or that a suitable worm gear arrangement or other power arrangement may be utilized in accordance with the present invention.

Accordingly, when the expansion frame 30 of the present invention is utilized, the first end 31 and the second end 32 are selectively secured to the first brick 19 and the second brick 20 at points remote to the key brick space 18. In the illustrated embodiment, the points of attachment of the expansion frame are shown to be on the outer exposed faces **19*b* and 20*b* of the bricks 19 and 20. It will be appreciated that the first end 31 and second end 32 could also be attached to the interior wall 19*a* and 20*a* of the bricks 19 and 20** respectively in accordance with the present invention.

Outward force is then exerted on the first extension bar 36 and the second extension bar 40 as shown by the arrows in FIG. 2 in order to lever the first end 31 and second end 32 outwardly as shown by the arrows in FIG. 1, whereby circumferential compressive force is exerted on the ring 13 to tighten the ring 13 and enlarge the key brick space 18.

Referring now to FIGS. 4 and 5, the present invention may further include the bricks 19 and 20 wherein the bricks 19, 20 are specially formed 30 to receive a member of the expansion frame to accommodate the attachment of the first and second ends 31, 32 to the bricks 19, 20. As shown in FIG. 4, wherein brick 19 is shown as illustrative of both bricks 19 and 20, the brick 19 may comprise any configuration suitable for fitting closely within the ring 13. In the preferred embodiment, the brick 19 has two opposing concentric arcuate sides 60 and 61 and two straight sides 62 and 63 which are slanted such that when the brick 19 is installed, the sides 62 and 63 would converge to the center of the cylindrical shell 10.

Referring still to FIGS. 4 and 5, the brick 19 includes a means for detachably securing the first end 31 of the expansion frame 30 to the brick 19 at a point on the brick 19 remote to the key brick space 18 in use. This means may comprise any suitable receiving means or member complementary in configuration to a corresponding connecting member secured to the first end 31. In the preferred embodiment, the means comprises a cylindrical bore 65 extending through the brick 19 wherein the cylindrical bore 65 extends inwardly from the outer exposed face in use of the brick 19 through the width 66 of the brick 19 as best shown in FIG. 5.

Accordingly, the apparatus of the present invention may further include a means by which the expansion frame 30 may be connected to the refractory brick ring 13 remote to the key brick space 18 in order to accommodate the tightening of the ring 13 and the maintenance of the compressive force utilized to tighten the ring 13 so that the maximum sized key brick may be inserted in the key brick space 18. The insertion of such a maximum sized key brick, in turn, insures that the maximum possible tightness of the ring 13 is maintained.

Referring now to FIG. 6 (wherein like members are given like reference numerals), there is shown an alternative embodiment of the expansion frame 30 of the present invention. In the alternative embodiment, the first extension bar 36 is secured to the second extension bar 40 by means of a linkage member **47*a* comprising a pin joint. The expansion frame 30 thereby has a V-shaped configuration which is expandable at the top of the V, whereby outward force may be exerted between the first end 31 and the second end 32 to apply the circumferential compressive force on the ring 13**.

Referring still to FIG. 6, there is shown an alternative embodiment of the power means 34 of the present invention. In the embodiment illustrated in FIG. 6, the power means 34 comprises a hydraulic cylinder 50 having a single extendable piston 51. The hydraulic cylinder 50 is pivotally secured to the second extension bar 40 and the piston bar 51 is pivotally secured to the first extension bar 36 such that extension of the piston 51 tends to forcibly spread the first end 31 and second end 32 to tighten the ring in use.

Accordingly, when the apparatus of the present invention is utilized in the method of the present invention, the first end 31 of the expansion frame 30 is detachably secured to the first brick 19 at a point on the first brick 19 remote to the key brick space 18 by inserting the extended member 45 into the bore 65. Similarly, the second end 32 of the expansion frame 30 is detachably secured to the second brick 20 at a point on the brick 20 remote to the key brick space 18 by inserting the extended member 45 connected to the second extension member 40 into the bore 65 of the second brick 20. It should be noticed that the expansion frame 30 is configured to be offset from the key brick space 18 when the first and second ends 31, 32 are attached to the first and second bricks 19, 20, as best seen in FIG. 1. Force is then exerted on the expansion frame 30 to expand the distance between the first and second ends 31, 32 in order to exert outwardly opposing force on the first and second bricks 19, 20 such that circumferential compressive force on the ring 13 to tighten the ring 13 is created. A key brick having a width and configuration substantially identical to the key brick space 18 is installed into the key brick space 18 while maintaining the outwardly opposing force on the first and second bricks 19, 20. The outward pressure on the expansion device 30 is then relieved and the expansion frame 30 is removed, leaving a tightly completed ring 13.

The instant invention has been disclosed in connection with specific embodiments. However it will be apparent to those skilled in the art that variations from the illustrated embodiments may be undertaken without departing from the spirit and scope of the invention. For example, the expansion frame 30 may take the form of a bowed spring having a horseshoe-shaped configuration, wherein the ends of the horseshoe are drawn inwardly to be inserted into the holes 65 in the bricks 19 and 20. The tendency of the springs to spread the ends will then provide the expansive force to exert circumferential compressive force on the ring. This and other variations will be apparent to those skilled in the art and are within the spirit and scope of the invention.

What is claimed is:

1. An apparatus for tightening a ring of refractory brick in order to accommodate the installation of a key brick into a key brick space of such a refractory brick ring to tightly close and complete the ring, the key brick space being bordered on either side by first and second opposing bricks, each including an outer exposed face, comprising:

(a) an expansion frame comprising (i) a first extension bar having a working end and a connecting end and including an extended member connected transversely to the first extension bar proximate the working end of the first extension bar, the extended member of the first extension bar being selectively attachable to such a first brick at a point on the first brick remote to the key brick space on the outer exposed face of such a first brick; and (ii) a second extension bar having a working end and a connecting end, the connecting end of the second extension bar being pivotally interconnected with the connecting end of the first extension bar, the second extension bar further including an extended member connected transversely to the second extension bar proximate the working end of the second extension bar, the extended member of the second extension bar being selectively attachable to such a second brick at a point on the second brick remote to the key brick space on the outer exposed face of such a second brick; and (b) power means associated with said expansion frame for providing outwardly opposing force on the working end of the first extension bar and the working end of the second extension bar whereby, in use, circumferential compressive force is exerted on the refractory brick ring remotely from the key brick space to tighten the ring.

2. The apparatus of claim 1 in which said first extension bar is pivotally connected to said second extension bar by an interconnecting linkage bar pivotally connected to the connecting end of the first extension bar and the connecting end of the second extension bar such that the first extension bar, the linkage bar and the second extension bar have a U-shaped configuration.

3. The apparatus of claim 1 further comprising the first brick and the second brick, the first brick having a bore therein positioned to extend into the first brick from a point on the outer exposed face remote to the key brick space in use, the second brick having a bore therein positioned to extend into the second brick from a point on the outer exposed face remote to the key brick space in use, wherein the extended member of the first extension bar has a configuration complementary to the bore in the first brick such that said extended member fits into the first brick bore to detachably secure the working end of the first extension bar to the first brick in use, and wherein the extended member of the second extension bar has a configuration complementary to the second brick bore such that said extended member fits into the second brick bore to detachably secure the working end of the second extension bar to the second brick in use.

4. The apparatus of claim 1 wherein said power means comprises a power cylinder having an extendable piston, said cylinder being pivotally connected to said first extension bar and said piston being pivotally connected to said second extension bar such that the extension of said piston from said cylinder spreads said first and second extension bars.

5. The apparatus of claim 4 wherein said power cylinder is hydraulically powered.

6. A method of tightening a ring of refractory brick in order to accommodate the installation of a key brick into a key brick space of such a refractory brick ring to tightly close and complete the ring, the key brick space being bordered on either side by first and second bricks, each including an outer exposed face, comprising the steps of:

(a) detachably securing a first end of an expansion frame to the first brick at a point on the outer exposed face of the first brick remote to the key brick space and a second end of the expansion frame to the second brick at a point on the outer exposed face of the second brick remote to the key brick space, the expansion frame being configured to be offset from the key brick space when the first and second ends are attached to the first and second bricks;

(b) expanding the distance between the first and second ends to exert outwardly opposing force on the first and second bricks in order to exert circumferential compressive force on the ring to tighten the ring; and (c) installing a key brick of width substantially equal to the key brick space into the key brick space while substantially maintaining the outwardly opposing force on the first and second bricks in order to complete the refractory brick ring.

* * * * *

UNITED STATES PATENT AND TRADEMARK OFFICE

CERTIFICATE OF CORRECTION

PATENT NO. : 4,584,812

DATED : April 29, 1986

INVENTOR(S) : John Miskolczi, Jr.

It is certified that error appears in the above-identified patent and that said Letters Patent is hereby corrected as shown below:

Column 5, line 3, after the word "formed", delete "30".

Column 5, line 4, after the word "frame", insert -- 30 --.

In Column 7, lines 23-24, delete "detachabIy" and insert --detachably--.

Signed and Sealed this

*Fifth* Day of *August 1986*

[SEAL]

*Attest:*

DONALD J. QUIGG

*Attesting Officer*

*Commissioner of Patents and Trademarks*